US011677149B2

(12) United States Patent
Lin et al.

(10) Patent No.: US 11,677,149 B2
(45) Date of Patent: Jun. 13, 2023

(54) MULTI-BAND ANTENNA

(71) Applicant: Cheng Uei Precision Industry Co., LTD., New Taipei (TW)

(72) Inventors: Ming-Ju Lin, New Taipei (TW); Lan-Yung Hsiao, New Taipei (TW); Chih-Chung Wang, New Taipei (TW); Shao-Kai Sun, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 8 days.

(21) Appl. No.: 17/579,571

(22) Filed: Jan. 19, 2022

(65) Prior Publication Data

US 2022/0368016 A1 Nov. 17, 2022

(30) Foreign Application Priority Data

May 12, 2021 (CN) ..... 202121007049.1

(51) Int. Cl.
*H01Q 1/24* (2006.01)
*H01Q 5/364* (2015.01)

(52) U.S. Cl.
CPC ..... *H01Q 5/364* (2015.01); *H01Q 1/243* (2013.01)

(58) Field of Classification Search
CPC ..... H01Q 1/243; H01Q 5/364
See application file for complete search history.

*Primary Examiner* — Graham P Smith
(74) *Attorney, Agent, or Firm* — Cheng-Ju Chiang

(57) ABSTRACT

A multi-band antenna includes a grounding portion, a feed-in portion, a feeding point, a first radiation portion, a second radiation portion, a third radiation portion and a fourth radiation portion. The feed-in portion has a first end edge, a second end edge, a first side edge and a second side edge. The feeding point is disposed at the feed-in portion. The first radiation portion is extended from the grounding portion. The second radiation portion is extended from the second end edge. The third radiation portion is extended from the first end edge. The fourth radiation portion is extended from an upper portion of the first end edge and an upper portion of the second end edge.

20 Claims, 7 Drawing Sheets

Start 500MHz Pwr 0 dBM Stop 6GHz

| Band(MHz) | Frequency (MHz) | Efficiency (%) |
|---|---|---|
| 700 | 704-824 | 55.56 |
| 800 | 791-894 | 60.72 |
| 900 | 880-960 | 50.47 |
| 1800 | 1710-1890 | 77.71 |
| 1900 | 1845-1995 | 77.98 |
| 2100 | 1920-2170 | 61.67 |
| 2300 | 2300-2360 | 71.84 |
| 2600 | 2500-2690 | 76.62 |
| 3500 | 3300-3800 | 53.10 |
| 4500 | 4400-5000 | 44.99 |

FIG. 7

MULTI-BAND ANTENNA

CROSS-REFERENCE TO RELATED APPLICATION

The present application is based on, and claims priority from, China Patent Application No. 202121007049.1, filed May 12, 2021, the disclosure of which is hereby incorporated by reference herein in its entirety.

BACKGROUND OF THE INVENTION

1. Field of the Invention

The present invention generally relates to a multi-band antenna, and more particularly to a multi-band antenna increasing frequency bandwidths in a finite volume condition.

2. The Related Art

With the vigorous development of high technology communication industries, more and more mobile communication devices are widely used. Especially 5G (Fifth Generation Mobile Communication Technology) network becomes more and more popular. Due to a 5G development, a 5G NR (New Radio) frequency bandwidth, a 5G millimeter wave frequency bandwidth and a FR1 (Frequency Range 1) have also appeared. Some frequency bandwidths are also overlapped with 4G (Fourth Generation Mobile Communication Technology) frequency bandwidth. Thus, a multi-band antenna demand of the mobile communication device is requested higher and higher. The mobile communication device is a cell phone.

However, because of market trends, antennas of the mobile communication devices are all received in housings of the mobile communication devices. Therefore, the antennas are limited by spaces of the housings. Moreover, a small planar inverted-F antenna (PIFA) is used as the antenna of the cell phone, so it is difficult to increase an application bandwidth under a certain antenna area condition. As a result, it has no way of satisfying multiple frequency bandwidths requirement.

Thus, it is essential to provide an innovative multi-band antenna increasing frequency bandwidths in a finite volume condition.

SUMMARY OF THE INVENTION

An object of the present invention is to provide a multi-band antenna. The multi-band antenna includes a grounding portion, a feed-in portion, a feeding point, a first radiation portion, a second radiation portion, a third radiation portion and a fourth radiation portion. The feed-in portion has a first end edge, a second end edge opposite to the first end edge, a first side edge, and a second side edge opposite to the first side edge. The first side edge is connected with a bottom of the second end edge. The first side edge is close to the grounding portion, and the first side edge keeps a distance from the grounding portion. The feeding point is disposed at a corner of the feed-in portion which is formed between the first side edge and the second end edge. The first radiation portion is extended from the grounding portion. The second radiation portion is extended from the second end edge of the feed-in portion. The first radiation portion and the second radiation portion are located to the same end of the feed-in portion. The first radiation portion surrounds the second radiation portion. The third radiation portion is extended from a lower portion of the first end edge of the feed-in portion. A junction between the third radiation portion and the feed-in portion is connected to the first side edge. The fourth radiation portion is extended from an upper portion of the first end edge and an upper portion of the second end edge of the feed-in portion. The fourth radiation portion and the third radiation portion are extended frontward from the first end edge of the feed-in portion. A junction between the fourth radiation portion and the feed-in portion is connected to the second side edge of the feed-in portion. The fourth radiation portion is located among the third radiation portion, the feed-in portion and the first radiation portion. An extending length of the first radiation portion is longer than an extending length of the second radiation portion. The extending length of the second radiation portion is longer than an extending length of the third radiation portion. An overall extending length of the third radiation portion is longer than an overall extending length of the fourth radiation portion.

Another object of the present invention is to provide a multi-band antenna. The multi-band antenna includes a grounding portion, a feed-in portion, a feeding point, a first radiation portion, a second radiation portion, a third radiation portion and a fourth radiation portion. The feed-in portion has a first end edge, a second end edge opposite to the first end edge, a first side edge, and a second side edge opposite to the first side edge. The first side edge is connected with a bottom of the second end edge. The first side edge is close to the grounding portion, and the first side edge keeps a distance from the grounding portion. The feeding point is disposed at the feed-in portion. The feeding point is close to the first side edge and the second end edge. A top edge of the grounding portion extends upward, then meanders rearward, and further extends upward and frontward to form the first radiation portion. An upper portion of the second end edge of the feed-in portion extends rearward to form the second radiation portion. A front of the second radiation portion is connected with the upper portion of the second end edge of the feed-in portion. The first radiation portion and the second radiation portion are located to the same end of the feed-in portion. A lower portion of the first end edge of the feed-in portion extends frontward and then extends upward to form the third radiation portion. A junction between the third radiation portion and the feed-in portion is connected to the first side edge. An upper portion of the first end edge of the feed-in portion extends frontward and opposite to the second radiation portion to form the fourth radiation portion. A junction between the fourth radiation portion and the feed-in portion is connected to the second side edge of the feed-in portion. The fourth radiation portion is located among the third radiation portion, the feed-in portion and the first radiation portion. An extending length of the first radiation portion is longer than an extending length of the second radiation portion. The extending length of the second radiation portion is longer than an extending length of the third radiation portion. An overall extending length of the third radiation portion is longer than an overall extending length of the fourth radiation portion.

Another object of the present invention is to provide a multi-band antenna. The multi-band antenna includes a grounding portion, a feed-in portion, a feeding point, a first radiation portion, a second radiation portion, a third radiation portion and a fourth radiation portion. The feed-in portion has a first end edge, a second end edge opposite to the first end edge, a first side edge, and a second side edge opposite to the first side edge. The first side edge is connected with a bottom of the second end edge. The first side edge is close to the grounding portion, and the first side edge keeps a distance from the grounding portion. The feeding point is formed at a corner of the feed-in portion between the first side edge and the second end edge. A top edge of the grounding portion extends upward, then meanders rearward, and further extends upward and frontward to form the first radiation portion. An upper portion of the second end edge of the feed-in portion extends rearward to form the second radiation portion. A front of the second radiation portion is connected with the upper portion of the second end edge of the feed-in portion. The first radiation portion and the second radiation portion are located to the same end of the feed-in portion. A lower portion of the first end edge of the feed-in portion extends frontward and then extends upward to form the third radiation portion. A junction between the third radiation portion and the feed-in portion is connected to the first side edge. An upper portion of the first end edge of the feed-in portion extends frontward and opposite to the second radiation portion to form the fourth radiation portion. A junction between the fourth radiation portion and the feed-in portion is connected to the second side edge of the feed-in portion. The fourth radiation portion is located among the third radiation portion, the feed-in portion and the first radiation portion. The first radiation portion surrounds the second radiation portion, the fourth radiation portion and the feed-in portion. An extending length of the first radiation portion is longer than an extending length of the second radiation portion. The extending length of the second radiation portion is longer than an extending length of the third radiation portion. An overall extending length of the third radiation portion is longer than an overall extending length of the fourth radiation portion.

As described above, the multi-band antenna feeds an electrical signal through the feeding point, a frequency bandwidth of the first radiation portion is ranged between 698 MHz and 960 MHz, a frequency bandwidth of the second radiation portion is ranged between 1400 MHz and 2700 MHz, a frequency bandwidth of the third radiation portion is ranged between 2500 MHz and 3800 MHz, and a frequency bandwidth of the fourth radiation portion is ranged between 4000 MHz and 5000 MHz. As a result, the multi-band antenna can increase the frequency bandwidths in a finite volume to appropriate for a miniaturization development trend of an electronic product which includes the multi-band antenna.

BRIEF DESCRIPTION OF THE DRAWINGS

The present invention will be apparent to those skilled in the art by reading the following description, with reference to the attached drawings, in which:

FIG. 7 is a test table of the multi-band antenna of FIG. 1.

DETAILED DESCRIPTION OF THE PREFERRED EMBODIMENT

Figure 1:
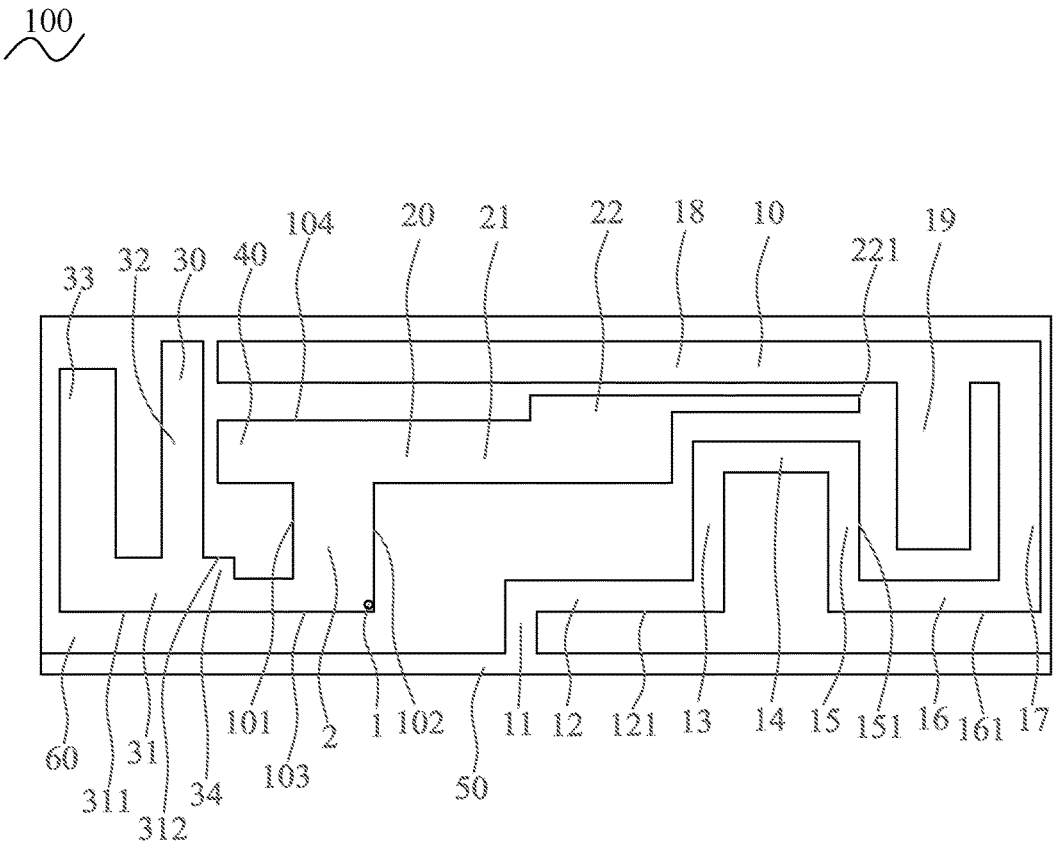
FIG. 1 is a diagrammatic drawing of a flat structure of a multi-band antenna in accordance with a preferred embodiment of the present invention.

With reference to FIG. 1 to FIG. 6, a multi-band antenna 100 in accordance with a preferred embodiment of the present invention is shown. The multi-band antenna 100 is adapted for being mounted to a circuit board 60. The multi-band antenna 100 includes a feeding point 1, a feed-in portion 2, a first radiation portion 10, a second radiation portion 20, a third radiation portion 30, a fourth radiation portion 40 and a grounding portion 50.

The multi-band antenna 100 is disposed on the circuit board 60. The feeding point 1 is disposed at one side of the feed-in portion 2. The feeding point 1 is disposed at a lower side of the feed-in portion 2. A current is transmitted to the lower side of the feed-in portion 2 from the feeding point 1. Extending directions of the feed-in portion 2 and the grounding portion 50 are perpendicular to each other. The feed-in portion 2 is spaced from the grounding portion 50. The feeding point 1, the feed-in portion 2, the first radiation portion 10, the second radiation portion 20, the third radiation portion 30 and the fourth radiation portion 40 are located to the same side of the grounding portion 50. The feeding point 1, the feed-in portion 2, the first radiation portion 10, the second radiation portion 20, the third radiation portion 30 and the fourth radiation portion 40 are located to an upper side of the grounding portion 50. The second radiation portion 20 is perpendicular to the feed-in portion 2. The second radiation portion 20 and the grounding portion 50 are parallel to each other. The second radiation portion 20 is spaced from the grounding portion 50.

The feed-in portion 2 is a rectangular plate shape. The feed-in portion 2 has a first end edge 101, a second end edge 102 opposite to the first end edge 101, a first side edge 103, and a second side edge 104 opposite to the first side edge 103. The first side edge 103 is connected with a bottom of the second end edge 102. The first side edge 103 is close to the grounding portion 50, and the first side edge 103 keeps a distance from the grounding portion 50. A position of the feeding point 1 is close to the first side edge 103 and the second end edge 102. An upper portion of the first end edge 101 of the feed-in portion 2 extends frontward and opposite to the second radiation portion 20 to form the fourth radiation portion 40. A lower portion of the first end edge 101 of the feed-in portion 2 extends frontward and then extends upward to form the third radiation portion 30. An upper portion of the second end edge 102 of the feed-in portion 2 extends rearward and opposite to the fourth radiation portion 40 to form the second radiation portion 20.

A front of the second radiation portion 20 is connected with the upper portion of the second end edge 102 of the feed-in portion 2. A top edge of the grounding portion 50 extends upward, then meanders rearward, and further extends upward and frontward to form the first radiation portion 10. The first radiation portion 10 surrounds the second radiation portion 20, the fourth radiation portion 40 and the feed-in portion 2. The first radiation portion 10 is extended from the grounding portion 50. The second radiation portion 20 is extended from the second end edge 102 of the feed-in portion 2. The third radiation portion 30 is extended from the lower portion of the first end edge 101 of the feed-in portion 2. The fourth radiation portion 40 is extended from the upper portion of the first end edge 101 of the feed-in portion 2. The feeding point 1 is disposed at a corner of the feed-in portion 2 which is formed between the second end edge 102 and the first side edge 103.

The first radiation portion 10 has a first upright portion 11, a first longitudinal portion 12, a second upright portion 13, a second longitudinal portion 14, a third upright portion 15, a third longitudinal portion 16, a fourth upright portion 17, a first extending portion 18 and a second extending portion 19. A middle of a top edge of the grounding portion 50 extends upward to form the first upright portion 11. The first upright portion 11 is perpendicular to the grounding portion 50. A bottom end of the first upright portion 11 is connected with the grounding portion 50. A top end of the first upright portion 11 is connected with the first longitudinal portion 12. The top end of the first upright portion 11 extends rearward and opposite to the feed-in portion 2 to form the first longitudinal portion 12.

The first longitudinal portion 12 is parallel with the grounding portion 50. The first longitudinal portion 12 is spaced from the grounding portion 50. A front end of the first longitudinal portion 12 is connected with the top end of the first upright portion 11. The first longitudinal portion 12 is perpendicular to the first upright portion 11. A rear end of the first longitudinal portion 12 is connected with the second upright portion 13. The rear end of the first longitudinal portion 12 extends upward to form the second upright portion 13. The second upright portion 13 is perpendicular to the first longitudinal portion 12. A bottom end of the second upright portion 13 is connected with the rear end of the first longitudinal portion 12.

A top end of the second upright portion 13 is connected with the second longitudinal portion 14. The top end of the second upright portion 13 extends rearward and opposite to the fourth radiation portion 40 to form the second longitudinal portion 14. The second longitudinal portion 14 is perpendicular to the second upright portion 13. A front end of the second longitudinal portion 14 is connected to the top end of the second upright portion 13. The second longitudinal portion 14 is parallel to the grounding portion 50.

A rear end of the second longitudinal portion 14 is connected with the third upright portion 15. The rear end of the second longitudinal portion 14 extends downward to form the third upright portion 15. The third upright portion 15 is perpendicular to the second longitudinal portion 14. A top end of the third upright portion 15 is connected with the rear end of the second longitudinal portion 14.

A bottom end of the third upright portion 15 is connected with the third longitudinal portion 16. The bottom end of the third upright portion 15 extends rearward and opposite to the feed-in portion 2 to form the third longitudinal portion 16. The third longitudinal portion 16 is perpendicular to the third upright portion 15. The third longitudinal portion 16 is spaced from the grounding portion 50. The third longitudinal portion 16 is parallel with the grounding portion 50. A front end of the third longitudinal portion 16 is connected with the bottom end of the third upright portion 15.

A rear end of the third longitudinal portion 16 is connected with the fourth upright portion 17. The rear end of the third longitudinal portion 16 extends upward to form the fourth upright portion 17. The fourth upright portion 17 is perpendicular to the third longitudinal portion 16. A bottom end of the fourth upright portion 17 is connected with the rear end of the third longitudinal portion 16.

A top end of the fourth upright portion 17 is connected with the first extending portion 18. The top end of the fourth upright portion 17 extends frontward and towards a top end of the third radiation portion 30 to form the first extending portion 18. The first extending portion 18 is perpendicular to the fourth upright portion 17. A rear end of the first extending portion 18 is connected with the top end of the fourth upright portion 17. The first extending portion 18 is located above the second radiation portion 20 and the fourth radiation portion 40. A front end of the first extending portion 18 is free.

One end of a bottom edge of the first extending portion 18 adjacent to the fourth upright portion 17 extends downward to form the second extending portion 19. The second extending portion 19 is perpendicular to the first extending portion 18. A top end of the second extending portion 19 is connected with the bottom edge of the first extending portion 18. A bottom end of the second extending portion 19 is free. The second extending portion 19 is disposed among the third upright portion 15, the third longitudinal portion 16, the fourth upright portion 17, the first extending portion 18 and the second radiation portion 20.

The second upright portion 13, the second longitudinal portion 14 and the third upright portion 15 are connected to form an inverted U shape. The third upright portion 15, the third longitudinal portion 16 and the fourth upright portion 17 are connected to form a U shape. The first longitudinal portion 12 and the second longitudinal portion 14 are parallel to each other. The second longitudinal portion 14 and the third longitudinal portion 16 are parallel to each other. The first longitudinal portion 12 and the third longitudinal portion 16 are in alignment with each other.

The first upright portion 11 is parallel to the feed-in portion 2. The second upright portion 13 is parallel to the first upright portion 11. The second longitudinal portion 14 is parallel to the first longitudinal portion 12. The third upright portion 15 is parallel to the second upright portion 13. The third longitudinal portion 16 is parallel to the second longitudinal portion 14. The fourth upright portion 17 is parallel to the third upright portion 15. The first extending portion 18 is parallel to the first longitudinal portion 12, the second longitudinal portion 14 and the third longitudinal portion 16. The second extending portion 19 is parallel to the first upright portion 11, the second upright portion 13, the third upright portion 15 and the fourth upright portion 17.

In the preferred embodiment, a longitudinal length of the first extending portion 18 of the first radiation portion 10 is the longest in the first radiation portion 10. A vertical length of the second upright portion 13 is longer than a vertical length of the first upright portion 11. The vertical length of the second upright portion 13 and a vertical length of the third upright portion 15 are the same. A vertical length of the fourth upright portion 17 is longer than the vertical length of the third upright portion 15.

The second extending portion 19, the first upright portion 11, the first longitudinal portion 12, the second upright portion 13, the second longitudinal portion 14, the third upright portion 15, the third longitudinal portion 16, the fourth upright portion 17 and the first extending portion 18 are the rectangular plate shapes. A width of the second extending portion 19 of the first radiation portion 10 is the widest among a width of the first upright portion 11, a width of the first longitudinal portion 12, a width of the second upright portion 13, a width of the second longitudinal portion 14, a width of the third upright portion 15, a width of the third longitudinal portion 16, a width of the fourth upright portion 17 and a width of the first extending portion 18 of the first radiation portion 10. The width of the first upright portion 11, the width of the first longitudinal portion 12, the width of the second upright portion 13, the width of the second longitudinal portion 14, the width of the third upright portion 15 and the width of the third longitudinal portion 16 are the same. The width of the fourth upright portion 17 and the width of the first extending portion 18 are the same. The width of the fourth upright portion 17 is wider than the width of the third longitudinal portion 16. The width of the second extending portion 19 is wider than the width of the first extending portion 18.

When the multi-band antenna 100 is used in a wireless communication, the first radiation portion 10 is coupled with the feeding point 1, so a frequency bandwidth of the first radiation portion 10 is ranged between 698 MHz and 960 MHz in an oscillation. In a concrete implementation, a vertical distance between the first radiation portion 10 and the second radiation portion 20, a longitudinal distance between the first radiation portion 10 and the third radiation portion 30 and a vertical distance between the first radiation portion 10 and the fourth radiation portion 40 are adjustable, so the frequency bandwidth of the first radiation portion 10 is changed.

An upper portion of the feed-in portion 2 extends rearward to form the second radiation portion 20. The second radiation portion 20 is perpendicular to the feed-in portion 2. A front end of the second radiation portion 20 is connected with the upper portion of the feed-in portion 2. The second radiation portion 20 and the grounding portion 50 are parallel to each other. The second radiation portion 20 is located among the third radiation portion 30, the feed-in portion 2, the grounding portion 50, the first upright portion 11, the first longitudinal portion 12, the second upright portion 13, the second longitudinal portion 14, the third upright portion 15, the first extending portion 18 and the second extending portion 19 of the first radiation portion 10. The first radiation portion 10 and the second radiation portion 20 are located to the same end of the feed-in portion 2.

The second radiation portion 20 has a third extending portion 21 and a fourth extending portion 22. The upper portion of the second end edge 102 of the feed-in portion 2 extends rearward and opposite to the fourth radiation portion 40 to form the third extending portion 21. A front end of the third extending portion 21 of the second radiation portion 20 is connected with the upper portion of the second end edge 102 of the feed-in portion 2. A rear end of an uppermost edge of the third extending portion 21 extends upward and then extends rearward to form the fourth extending portion 22. A front end of a lower edge of the fourth extending portion 22 is connected with the rear end of the uppermost edge of the third extending portion 21. A rear end of the fourth extending portion 22 is free. An outer edge 221 of the rear end of the fourth extending portion 22 is flush with an extreme edge 151 of the third upright portion 15. The second side edge 104 of the feed-in portion 2 is flush with a front end of the uppermost edge of the third extending portion 21 and an upper edge of the fourth radiation portion 40. The second side edge 104 of the feed-in portion 2 and the front end of the uppermost edge of the third extending portion 21 are parallel with an upper edge of the fourth extending portion 22.

In the preferred embodiment, the third extending portion 21 of the second radiation portion 20 is located among the feed-in portion 2, the grounding portion 50, the first upright portion 11, the first longitudinal portion 12, the second upright portion 13, the first extending portion 18 and the second extending portion 19 of the first radiation portion 10. The fourth extending portion 22 of the second radiation portion 20 is located among the third extending portion 21, the second longitudinal portion 14, the first extending portion 18, the second extending portion 19 of the first radiation portion 10 and the third radiation portion 30. The third extending portion 21 and the fourth extending portion 22 are the rectangular plate shapes. A width of the third extending portion 21 is wider than a width of the fourth extending portion 22. A width of a front end of the second radiation portion 20 is wider than a width of the third radiation portion 30.

When the multi-band antenna 100 is used in the wireless communication, the current is fed into the feed-in portion 2, the current is fed into the multi-band antenna 100 through the feeding point 1 of the feed-in portion 2. The current passes through the feed-in portion 2 and the second radiation portion 20 to generate the oscillation. A frequency bandwidth of the second radiation portion 20 is ranged between 1400 MHz and 2700 MHz in the oscillation.

A front edge of the feed-in portion 2 extends frontward and then extends upward to form the third radiation portion 30. The lower portion of the first end edge 101 of the feed-in portion 2 extends frontward and then extends upward to form the third radiation portion 30. A position of the third radiation portion 30 is corresponding to the lower portion of the first end edge 101 of the feed-in portion 2, a front end of the fourth radiation portion 40 and the front end of the first extending portion 18 of the first radiation portion 10. The third radiation portion 30 is connected with the lower portion of the first end edge 101 of the feed-in portion 2. The fourth radiation portion 40 is extended frontward and towards the third radiation portion 30 from an upper portion of the first end edge 101 of the feed-in portion 2.

The third radiation portion 30 has a connecting portion 31, a first branch 32, a second branch 33 and a protruding portion 34. A junction between the third radiation portion 30 and the feed-in portion 2 is close to the first side edge 103, and the junction between the third radiation portion 30 and the feed-in portion 2 is connected to the first side edge 103.

The lower portion of the first end edge 101 of the feed-in portion 2 extends frontward to form the connecting portion 31. The connecting portion 31 is located under the fourth radiation portion 40. The connecting portion 31 is perpendicular to the feed-in portion 2. The connecting portion 31 is parallel to the grounding portion 50. The connecting portion 31 is spaced from the grounding portion 50. A rear end of the connecting portion 31 is close to the first side edge 103, and the rear end of the connecting portion 31 is connected to the first side edge 103. The rear end of the connecting portion 31 is connected to the feed-in portion 2. A lower edge of the connecting portion 31 is defined as a first connecting edge 311. A top edge of the connecting portion 31 is defined as a second connecting edge 312. The first connecting edge 311 of the connecting portion 31 is connected with the first side edge 103 of the feed-in portion 2. The first connecting edge 311 of the connecting portion 31 is flush with the first side edge 103 of the feed-in portion 2. A middle of the second connecting edge 312 of the connecting portion 31 extends upward to form the first branch 32. A front end of the connecting portion 31 extends upward to form the second branch 33. The second branch 33 is perpendicular to the connecting portion 31. The first branch 32 is located between the second branch 33 and feed-in portion 2. A bottom end of the first branch 32 is connected with the connecting portion 31.

A top end of the first branch 32 is free. The first branch 32 is perpendicular to the connecting portion 31. A junction between the connecting portion 31 and the first branch 32 protrudes upward and towards the feed-in portion 2 to form the protruding portion 34. The protruding portion 34 is formed at a corner between a rear edge of the first branch 32 and the second connecting edge 312 of the connecting portion 31. The protruding portion 34 is located among the connecting portion 31, the first branch 32, the feed-in portion 2 and the fourth radiation portion 40. The top end of the first branch 32 is corresponding to the front end of the first extending portion 18. The top end of the first branch 32 of the third radiation portion 30 is spaced from the front end of the first extending portion 18 of the first radiation portion 10. A vertical edge of the first branch 32 is parallel to a front edge of the first extending portion 18.

An extending direction of the first branch 32 of the third radiation portion 30 is perpendicular to an extending direction of the first extending portion 18 of the first radiation portion 10. Topmost edges of the third radiation portion 30 and the first extending portion 18 are flush. A front end of the second connecting edge 312 of the connecting portion 31 extends upward to form the second branch 33. The second branch 33 is perpendicular to the connecting portion 31. A bottom end of the second branch 33 is connected with the connecting portion 31. A top end of the second branch 33 is free. The first branch 32 is spaced from the second branch 33. The first branch 32 is parallel to the second branch 33. A free end of the first branch 32 of the third radiation portion 30 is spaced from a free end of the first extending portion 18 of the first radiation portion 10. The first branch 32 is parallel to the second branch 33.

In the preferred embodiment, the connecting portion 31, the first branch 32, the second branch 33 and the protruding portion 34 are the rectangular plate shapes. A width of the second branch 33 is wider than a width of the first branch 32. A length of the first branch 32 is longer than a length of the second branch 33. A topmost edge of the first branch 32 is flush with the topmost edge of the first extending portion 18. A lower edge of the first longitudinal portion 12 is defined as a first longitudinal edge 121. A lower edge of the third longitudinal portion 16 is defined as a second longitudinal edge 161. The first connecting edge 311 of the connecting portion 31 is flush with the first longitudinal edge 121 of the first longitudinal portion 12 and the second longitudinal edge 161 of the third longitudinal portion 16. The first connecting edge 311 of the connecting portion 31 is parallel with the first longitudinal edge 121 of the first longitudinal portion 12 and a lower edge of the second longitudinal portion 14.

When the multi-band antenna 100 is used in the wireless communication, the current is fed into the feed-in portion 2, the connecting portion 31 of the third radiation portion 30 and the first branch 32 of the third radiation portion 30. The current passes through the feed-in portion 2, the connecting portion 31 and the first branch 32 of the third radiation portion 30, so a frequency bandwidth of the third radiation portion 30 is ranged between 2500 MHz and 3800 MHz in the oscillation. The second branch 33 of the third radiation portion 30 is coupled with the feeding point 1, the frequency bandwidth is ranged between 1800 MHz and 2500 MHz in the oscillation. The first branch 32 and the second branch 33 are resonated, the frequency bandwidth is ranged between 3300 MHz and 4000 MHz which is generated in the resonance between the first branch 32 and the second branch 33. In the concrete implementation, a distance between the first branch 32 and the second branch 33 is adjustable to make a resonance frequency of the first branch 32 and the second branch 33 become larger. A distance between the first branch 32 and the fourth radiation portion 40, and a distance between the first branch 32 and the first extending portion 18 of the first radiation portion 10 are adjustable, so the frequency bandwidth which is ranged between 2500 MHz and 3800 MHz is changed by virtue of adjusting the distance between the first branch 32 and the fourth radiation portion 40, and the distance between the first branch 32 and the first extending portion 18 of the first radiation portion 10.

The upper portion of the feed-in portion 2 extends frontward and opposite to the second radiation portion 20 to form the fourth radiation portion 40. The fourth radiation portion 40 is perpendicular to the feed-in portion 2. Thus, the fourth radiation portion 40 is parallel to the grounding portion 50. The fourth radiation portion 40 is the rectangular plate shape. The grounding portion 50 is the rectangular plate shape. An overall extending length of the fourth radiation portion 40 is longer than a width of the fourth radiation portion 40. The fourth radiation portion 40 is corresponding to and is located under the front end of the first extending portion 18. A rear end of the fourth radiation portion 40 is connected with the upper portion of the first end edge 101 of the feed-in portion 2. The rear end of the fourth radiation portion 40 is close to the second side edge 104 of the feed-in portion 2. A front end of the fourth radiation portion 40 is free.

In the preferred embodiment, the fourth radiation portion 40 is located among the first branch 32 of the third radiation portion 30, the protruding portion 34, the connecting portion 31 of the third radiation portion 30, the feed-in portion 2 and the first extending portion 18 of the first radiation portion 10. The fourth radiation portion 40 and the third radiation portion 30 are extended from the same edge of the feed-in portion 2. The fourth radiation portion 40 and the third radiation portion 30 are extended frontward from the first end edge 101 of the feed-in portion 2. The front edge of the first extending portion 18 is flush with a front edge of the fourth radiation portion 40. A junction between the fourth radiation portion 40 and the feed-in portion 2 is close to the second side edge 104 of the feed-in portion 2, and the junction between the fourth radiation portion 40 and the feed-in portion 2 is connected to the second side edge 104 of the feed-in portion 2.

When the multi-band antenna 100 is used in the wireless communication, the current passes through the feed-in portion 2 and the fourth radiation portion 40, a frequency bandwidth of the fourth radiation portion 40 is ranged between 4000 MHz and 5000 MHz in the oscillation. In the concrete implementation, a distance between the fourth radiation portion 40 and the first extending portion 18 of the first radiation portion 10 is adjustable, and the distance between the fourth radiation portion 40 and the first branch 32 of the third radiation portion 30 is adjustable, so the frequency bandwidth which is ranged between 4000 MHz and 5000 MHz is changed by virtue of adjusting the distance between the fourth radiation portion 40 and the first extending portion 18, and the distance between the fourth radiation portion 40 and the first branch 32.

In the preferred embodiment, the frequency bandwidth of the first radiation portion 10 is ranged between 698 MHz and 960 MHz. The frequency bandwidth of the second radiation portion 20 is ranged between 1400 MHz and 2700 MHz. The frequency bandwidth of the third radiation portion 30 is ranged between 2500 MHz and 3800 MHz. The frequency bandwidth of the fourth radiation portion 40 is ranged between 4000 MHz and 5000 MHz. Thus, the multi-band antenna 100 increases the frequency bandwidths in a finite volume.

In the preferred embodiment, an extending length of the first radiation portion 10 is longer than an extending length of the second radiation portion 20. The extending length of the second radiation portion 20 is longer than an extending length of the third radiation portion 30. An overall extending length of the third radiation portion 30 is longer than the overall extending length of the fourth radiation portion 40.

Figure 2:
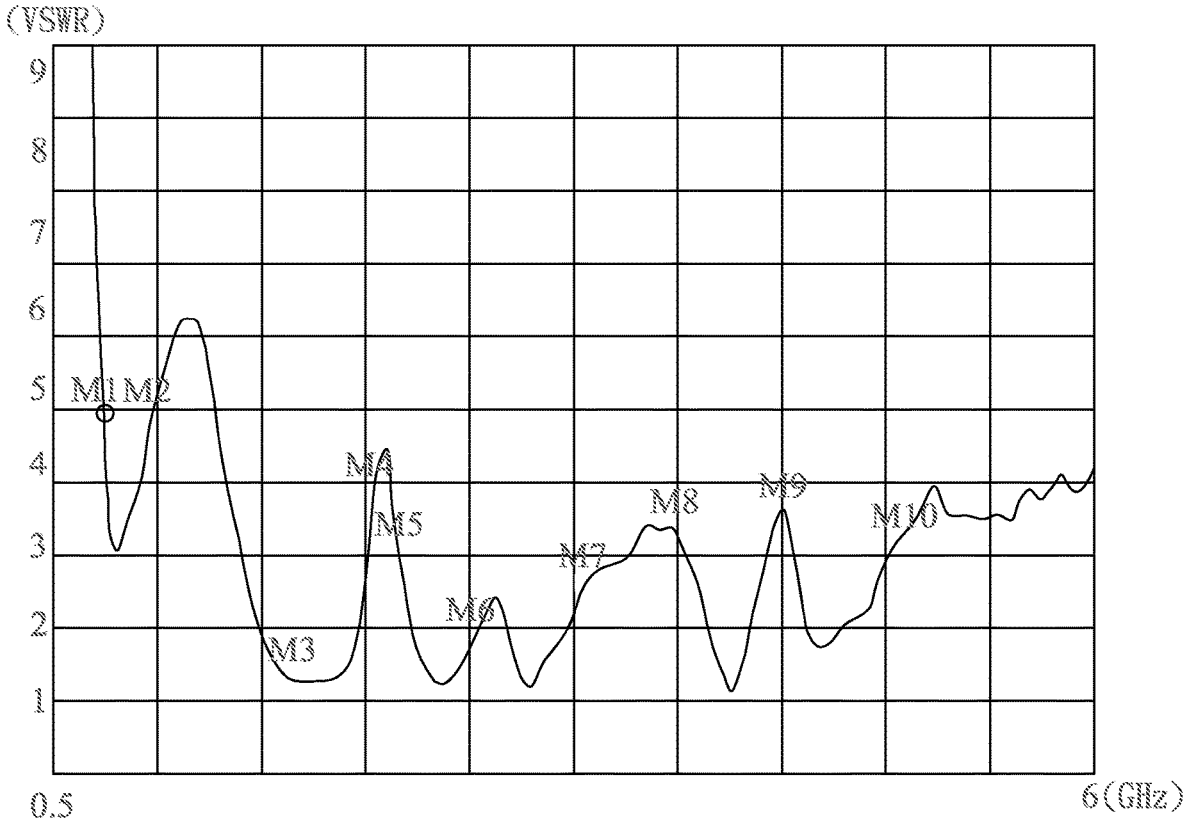
FIG. 2 is a test chart of a Voltage Standing Wave Ratio (VSWR) of the multi-band antenna of FIG. 1.
Figure 3:
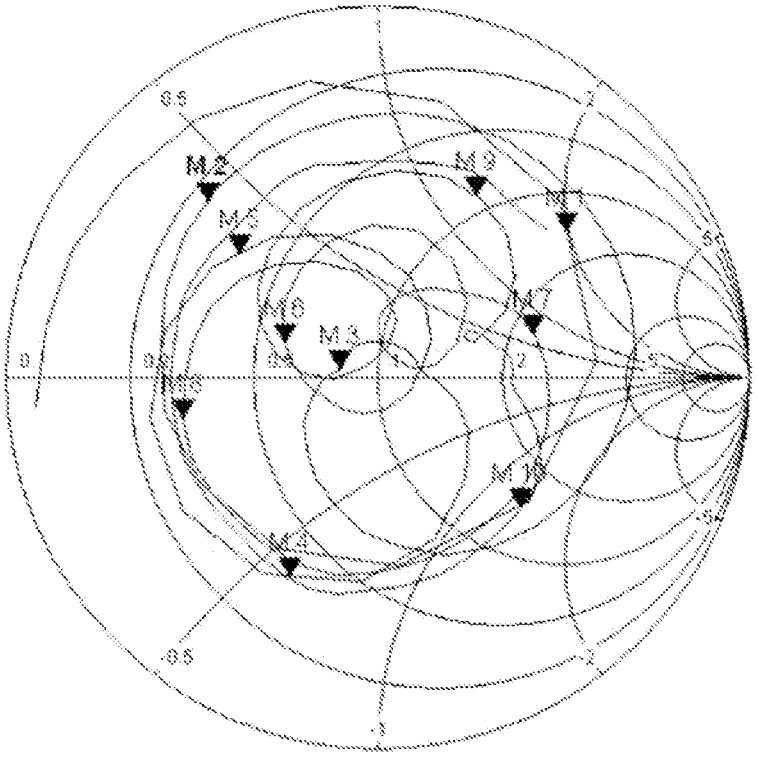
FIG. 3 is a Smith Chart of the multi-band antenna of FIG. 1.

Referring to FIG. 1, FIG. 2 and FIG. 3, a VSWR (Voltage Standing Wave Ratio) test chart of the multi-band antenna 100 is shown in FIG. 2. A Smith chart of the multi-band antenna 100 is shown in FIG. 3. When the multi-band antenna 100 is operated at 698 MHz, a voltage standing wave ratio value of a point M1 is 4.9978. When the multi-band antenna 100 is operated at 960 MHz, a voltage standing wave ratio value of a point M2 is 4.9155. When the multi-band antenna 100 is operated at 1710 MHz, a voltage standing wave ratio value of a point M3 is 1.2345. When the multi-band antenna 100 is operated at 2170 MHz, a voltage standing wave ratio value of a point M4 is 3.9557. When the multi-band antenna 100 is operated at 2300 MHz, a voltage standing wave ratio value of a point M5 is 3.0778. When the multi-band antenna 100 is operated at 2690 MHz, a voltage standing wave ratio value of a point M6 is 1.7264. When the multi-band antenna 100 is operated at 3300 MHz, a voltage standing wave ratio value of a point M7 is 2.5388. When the multi-band antenna 100 is operated at 3800 MHz, a voltage standing wave ratio value of a point M8 is 3.3024. When the multi-band antenna 100 is operated at 4400 MHz, a voltage standing wave ratio value of a point M9 is 3.5230. When the multi-band antenna 100 is operated at 5000 MHz, a voltage standing wave ratio value of a point M10 is 3.1716. Thus, the multi-band antenna 100 is able to be operated stably in the frequency bandwidth ranged between 698 MHz and 960 MHz, the frequency bandwidth ranged between 1400 MHz and 2700 MHz, the frequency bandwidth ranged between 2500 MHz and 3800 MHz and the frequency bandwidth ranged between 4000 MHz and 5000 MHz.

Figure 4:
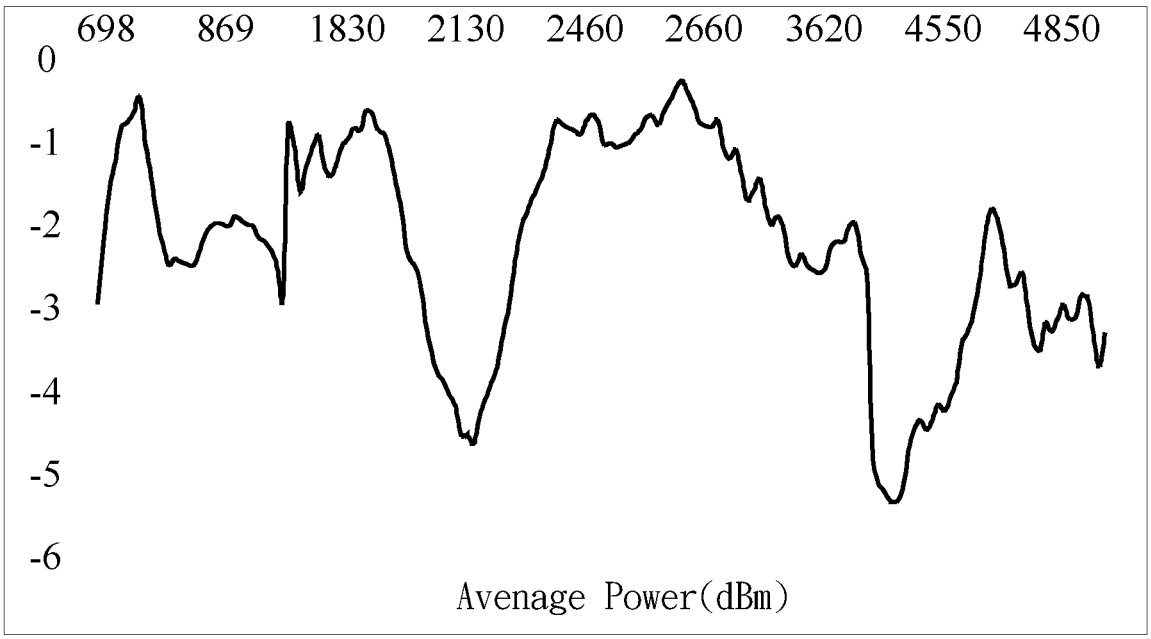
FIG. 4 is an average power chart of the multi-band antenna of FIG. 1.

Referring to FIG. 1 and FIG. 4, an average power chart of the multi-band antenna 100 is shown in FIG. 4. A loss degree of the multi-band antenna 100 is shown. When average power is higher, a loss of the multi-band antenna 100 is smaller, so that a radiation energy of the multi-band antenna 100 becomes larger. In the preferred embodiment, the average power of a lower frequency bandwidth is within −3 dBm.

Figure 5:
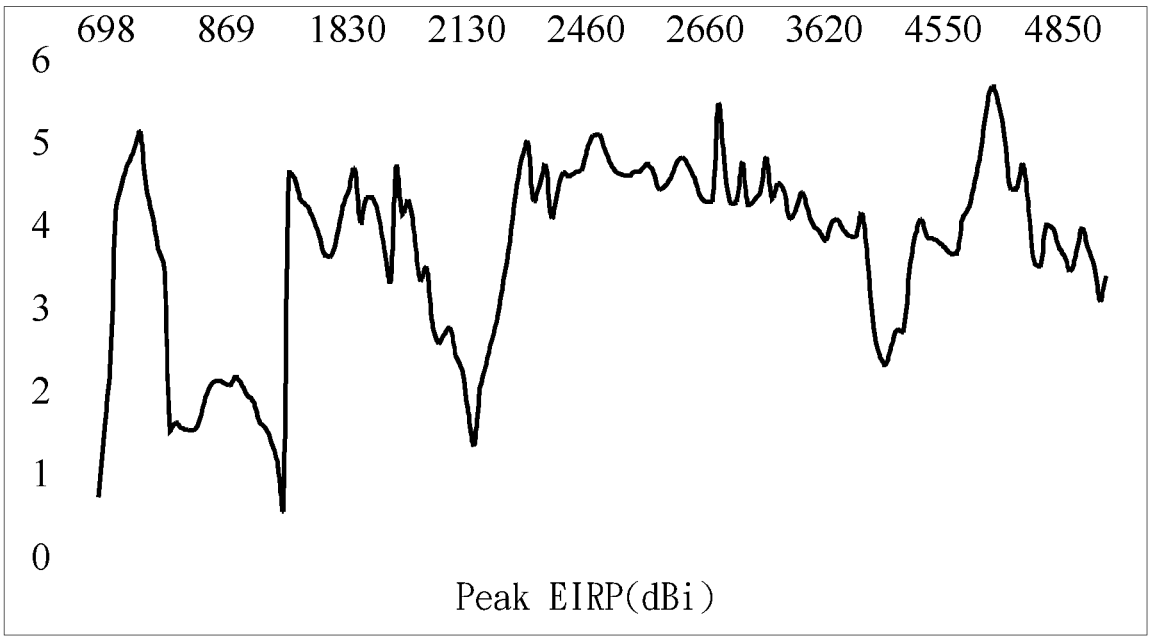
FIG. 5 is an equivalent isotropic radiated power (EIRP) chart of the multi-band antenna of FIG. 1.

Referring to FIG. 1 and FIG. 5, a peak equivalent isotropic radiated power (EIRP) chart of the multi-band antenna 100 is shown in FIG. 5. A maximum value of each frequency radiation of the multi-band antenna 100 is shown in the peak equivalent isotropic radiated power (EIRP) chart of the multi-band antenna 100. In the preferred embodiment, if peak values of equivalent isotropic radiated power in a whole frequency bandwidth are within the same range, power of the multi-band antenna 100 is stable.

Figure 6:
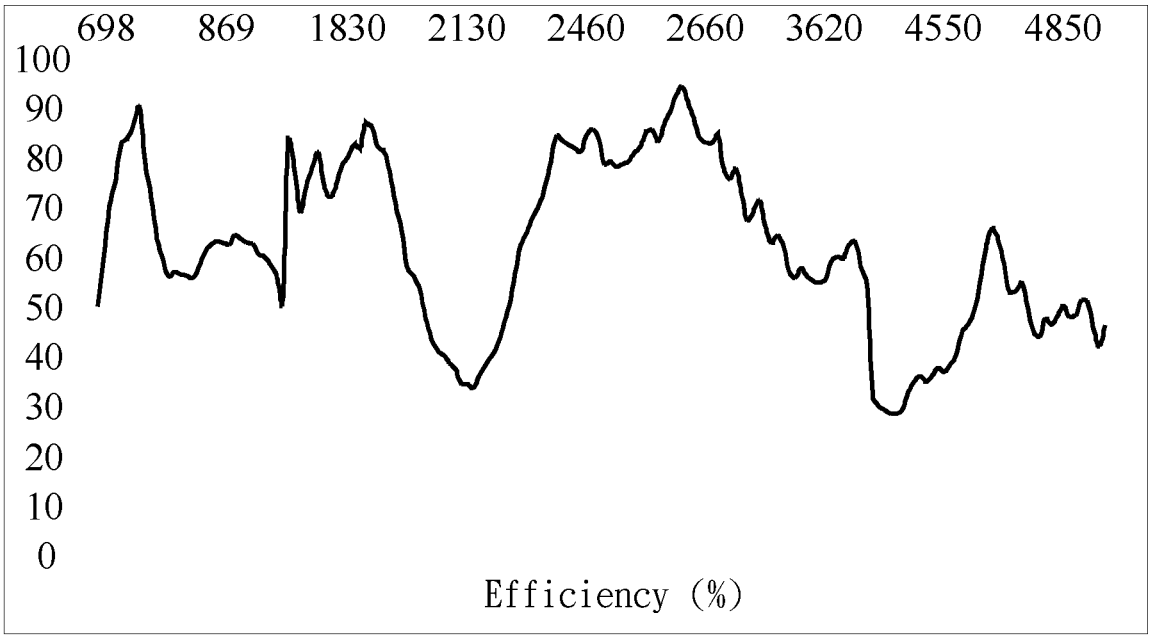
FIG. 6 is an efficiency chart of the multi-band antenna of FIG. 1.

Referring to FIG. 1, FIG. 6 and FIG. 7, an efficiency chart of the multi-band antenna 100 is shown in FIG. 6, and the test table shown in FIG. 7 is a data sheet of the multi-band antenna 100. The multi-band antenna 100 of FIG. 6 shows that the average power is converted into a radiation efficiency. In the different frequencies, the higher the efficiency value is, the better the frequency is. In the whole frequency bandwidth, the lower frequency bandwidths are more than fifth percent. Thus, the multi-band antenna 100 achieves the high efficiency vale of each lower frequency bandwidth in the finite volume, and the multi-band antenna 100 keeps the higher frequency bandwidths and the efficiency value of each higher frequency bandwidth.

As described above, the multi-band antenna 100 feeds an electrical signal through the feeding point 1, the frequency bandwidth of the first radiation portion 10 is ranged between 698 MHz and 960 MHz, the frequency bandwidth of the second radiation portion 20 is ranged between 1400 MHz and 2700 MHz, the frequency bandwidth of the third radiation portion 30 is ranged between 2500 MHz and 3800 MHz, and the frequency bandwidth of the fourth radiation portion 40 is ranged between 4000 MHz and 5000 MHz. As a result, the multi-band antenna 100 can increase the frequency bandwidths in the finite volume to appropriate for a miniaturization development trend of an electronic product which includes the multi-band antenna 100.

What is claimed is:

1. A multi-band antenna, comprising:

a grounding portion;

a feed-in portion having a first end edge, a second end edge opposite to the first end edge, a first side edge, and a second side edge opposite to the first side edge, the first side edge being connected with a bottom of the second end edge, the first side edge being close to the grounding portion, and the first side edge keeping a distance from the grounding portion;

a feeding point disposed at a corner of the feed-in portion which is formed between the first side edge and the second end edge;

a first radiation portion extended from the grounding portion;

a second radiation portion extended from the second end edge of the feed-in portion, the first radiation portion and the second radiation portion being located to the same end of the feed-in portion, the first radiation portion surrounding the second radiation portion;

a third radiation portion extended from a lower portion of the first end edge of the feed-in portion, a junction between the third radiation portion and the feed-in portion being connected to the first side edge; and a fourth radiation portion extended from an upper portion of the first end edge and an upper portion of the second end edge of the feed-in portion, the fourth radiation portion and the third radiation portion being extended frontward from the first end edge of the feed-in portion, a junction between the fourth radiation portion and the feed-in portion being connected to the second side edge of the feed-in portion, the fourth radiation portion being located among the third radiation portion, the feed-in portion and the first radiation portion;

wherein an extending length of the first radiation portion is longer than an extending length of the second radiation portion, the extending length of the second radiation portion is longer than an extending length of the third radiation portion, an overall extending length of the third radiation portion is longer than an overall extending length of the fourth radiation portion.

2. The multi-band antenna as claimed in claim 1, wherein the upper portion of the first end edge of the feed-in portion extends frontward and opposite to the second radiation portion to form the fourth radiation portion, the lower portion of the first end edge of the feed-in portion extends frontward and then extends upward to form the third radiation portion, an upper portion of the second end edge of the feed-in portion extends rearward and opposite to the fourth radiation portion to form the second radiation portion, a front of the second radiation portion is connected with the upper portion of the second end edge of the feed-in portion, a top edge of the grounding portion extends upward, then meanders rearward, and further extends upward and frontward to form the first radiation portion, the first radiation portion surrounds the second radiation portion, the fourth radiation portion and the feed-in portion.

3. The multi-band antenna as claimed in claim 1, wherein the first radiation portion has a first upright portion, a middle of the top edge of the grounding portion extends upward to form the first upright portion, a top end of the first upright portion extends rearward and opposite to the feed-in portion to form a first longitudinal portion, a rear end of the first longitudinal portion extends upward to form a second upright portion, a top end of the second upright portion extends rearward and opposite to the fourth radiation portion to form a second longitudinal portion, a rear end of the second longitudinal portion extends downward to form a third upright portion, a bottom end of the third upright portion extends rearward and opposite to the feed-in portion to form a third longitudinal portion, a rear end of the third longitudinal portion extends upward to form a fourth upright portion, a top end of the fourth upright portion extends frontward and towards a top end of the third radiation portion to form a first extending portion, one end of a bottom edge of the first extending portion adjacent to the fourth upright portion extends downward to form a second extending portion, the first upright portion is perpendicular to the grounding portion, a bottom end of the first upright portion is connected with the grounding portion, the top end of the first upright portion is connected with the first longitudinal portion.

4. The multi-band antenna as claimed in claim 3, wherein the second radiation portion is located among the feed-in portion, the grounding portion, the first upright portion, the first longitudinal portion, the second upright portion, the second longitudinal portion, the first extending portion and the second extending portion of the first radiation portion.

5. The multi-band antenna as claimed in claim 3, wherein the upper portion of the first end edge of the feed-in portion extends frontward and opposite to the second radiation portion to form the fourth radiation portion, the fourth radiation portion is perpendicular to the feed-in portion, the fourth radiation portion is parallel to the grounding portion, the fourth radiation portion is corresponding to and is located under a front end of the first extending portion, a rear end of the fourth radiation portion is connected with the upper portion of the first end edge of the feed-in portion, the rear end of the fourth radiation portion is close to the second side edge of the feed-in portion, a front end of the fourth radiation portion is free, a front edge of the first extending portion is flush with a front edge of the fourth radiation portion.

6. The multi-band antenna as claimed in claim 3, wherein the second radiation portion has a third extending portion and a fourth extending portion, the upper portion of the second end edge of the feed-in portion extends rearward and opposite to the fourth radiation portion to form the third extending portion, a front end of the third extending portion of the second radiation portion is connected with the upper portion of the second end edge of the feed-in portion, a rear end of an uppermost edge of the third extending portion extends upward and then extends rearward to form the fourth extending portion, a front end of a lower edge of the fourth extending portion is connected with the rear end of the uppermost edge of the third extending portion, the second side edge of the feed-in portion is flush with a front end of the uppermost edge of the third extending portion and an upper edge of the fourth radiation portion.

7. The multi-band antenna as claimed in claim 6, wherein the third radiation portion is corresponding to the lower portion of the first end edge of the feed-in portion, a front end of the fourth radiation portion and a front end of the first extending portion of the first radiation portion, the third radiation portion is connected with the lower portion of the first end edge of the feed-in portion, the fourth radiation portion is extended frontward and towards the third radiation portion from the upper portion of the first end edge of the feed-in portion.

8. The multi-band antenna as claimed in claim 6, wherein the third extending portion of the second radiation portion is located among the feed-in portion, the grounding portion, the first upright portion, the first longitudinal portion, the second upright portion, the first extending portion and the second extending portion of the first radiation portion, an outer edge of a rear end of the fourth extending portion is flush with an extreme edge of the third upright portion, the fourth extending portion of the second radiation portion is located among the third extending portion, the second longitudinal portion, the first extending portion and the second extending portion, a width of the third extending portion is wider than a width of the fourth extending portion.

9. The multi-band antenna as claimed in claim 3, wherein the third radiation portion has a connecting portion, the lower portion of the first end edge of the feed-in portion extends frontward to form the connecting portion located under the fourth radiation portion, the connecting portion is perpendicular to the feed-in portion, the connecting portion is parallel to the grounding portion, the connecting portion is spaced from the grounding portion, a rear end of the connecting portion is connected to the first side edge, a lower edge of the connecting portion is defined as a first connecting edge, a top edge of the connecting portion is defined as a second connecting edge, the first connecting edge of the connecting portion is connected with the first side edge of the feed-in portion, the first connecting edge of the connecting portion is flush with the first side edge of the feed-in portion, a middle of the second connecting edge of the connecting portion extends upward to form a first branch, a front end of the connecting portion extends upward to form a second branch, the second branch is perpendicular to the connecting portion, the first branch is located between the second branch and feed-in portion, a junction between the connecting portion and the first branch protrudes upward and towards the feed-in portion to form a protruding portion, the protruding portion is located among the connecting portion, the first branch, the feed-in portion and the fourth radiation portion, a top end of the first branch is corresponding to a front end of the first extending portion, the top end of the first branch is spaced from the front end of the first extending portion of the first radiation portion, an extending direction of the first branch is perpendicular to an extending direction of the first extending portion, topmost edges of the third radiation portion and the first extending portion are flush.

10. The multi-band antenna as claimed in claim 9, wherein the first branch is parallel to the second branch, a width of the second branch is wider than a width of the first branch, a length of the first branch is longer than a length of the second branch, a vertical edge of the first branch is parallel to a front edge of the first extending portion, a topmost edge of the first branch is flush with a topmost edge of the first extending portion, a lower edge of the first longitudinal portion is defined as a first longitudinal edge, a lower edge of the third longitudinal portion is defined as a second longitudinal edge, the first connecting edge of the connecting portion is flush with the first longitudinal edge of the first longitudinal portion and the second longitudinal edge of the third longitudinal portion, the first connecting edge of the connecting portion is parallel with the first longitudinal edge of the first longitudinal portion and a lower edge of the second longitudinal portion.

11. The multi-band antenna as claimed in claim 9, wherein the fourth radiation portion is extended frontward and towards the third radiation portion from the upper portion of the first end edge of the feed-in portion, a rear end of the fourth radiation portion is close to the second side edge of the feed-in portion, the fourth radiation portion and the third radiation portion are extended from the same edge of the feed-in portion, the fourth radiation portion is located among the first branch of the third radiation portion, the protruding portion, the connecting portion of the third radiation portion, the feed-in portion and the first extending portion of the first radiation portion.

12. The multi-band antenna as claimed in claim 3, wherein the first longitudinal portion is parallel with the grounding portion, the first longitudinal portion is spaced from the grounding portion, a front end of the first longitudinal portion is connected with the top end of the first upright portion, the rear end of the first longitudinal portion is connected with the second upright portion, the rear end of the first longitudinal portion extends upward to form the second upright portion, the second longitudinal portion is perpendicular to the second upright portion, a front end of the second longitudinal portion is connected to the top end of the second upright portion, a rear end of the second longitudinal portion is connected with the third upright portion, the rear end of the second longitudinal portion extends downward to form the third upright portion, the third longitudinal portion is perpendicular to the third upright portion, the third longitudinal portion is spaced from the grounding portion, a front end of the third longitudinal portion is connected with the bottom end of the third upright portion, the rear end of the third longitudinal portion is connected with the fourth upright portion, the fourth upright portion is perpendicular to the third longitudinal portion.

13. The multi-band antenna as claimed in claim 3, wherein the second upright portion is perpendicular to the first longitudinal portion, a bottom end of the second upright portion is connected with the rear end of the first longitudinal portion, the top end of the second upright portion is connected with the second longitudinal portion, the top end of the second upright portion extends rearward and opposite to the fourth radiation portion to form the second longitudinal portion, the second longitudinal portion is parallel to the grounding portion.

14. The multi-band antenna as claimed in claim 3, wherein the third upright portion is perpendicular to the second longitudinal portion, a top end of the third upright portion is connected with a rear end of the second longitudinal portion, the bottom end of the third upright portion is connected with the third longitudinal portion, the bottom end of the third upright portion extends rearward and opposite to the feed-in portion to form the third longitudinal portion, a bottom end of the fourth upright portion is connected with the rear end of the third longitudinal portion, the top end of the fourth upright portion is connected with the first extending portion.

15. The multi-band antenna as claimed in claim 3, wherein the first extending portion is perpendicular to the fourth upright portion, a rear end of the first extending portion is connected with the top end of the fourth upright portion, a front end of the first extending portion is free, the second extending portion is perpendicular to the first extending portion, a top end of the second extending portion is connected with the bottom edge of the first extending portion, a bottom end of the second extending portion is free, the second extending portion is disposed among the third upright portion, the third longitudinal portion, the fourth upright portion, the first extending portion and the second radiation portion.

16. The multi-band antenna as claimed in claim 3, wherein the first upright portion is parallel to the feed-in portion, the feeding point is formed at a corner of the feed-in portion between the first side edge and the second end edge, the second upright portion is parallel to the first upright portion, the third upright portion is parallel to the second upright portion, the fourth upright portion is parallel to the third upright portion, the first extending portion is parallel to the first longitudinal portion, the second longitudinal portion and the third longitudinal portion, the second extending portion is parallel to the first upright portion, the second upright portion, the third upright portion and the fourth upright portion, the second upright portion, the second longitudinal portion and the third upright portion are connected to form an inverted U shape, the third upright portion, the third longitudinal portion and the fourth upright portion are connected to form a U shape, the first longitudinal portion and the second longitudinal portion are parallel to each other, the second longitudinal portion and the third longitudinal portion are parallel to each other, the first longitudinal portion and the third longitudinal portion are in alignment with each other.

17. The multi-band antenna as claimed in claim 3, wherein the second radiation portion has a third extending portion and a fourth extending portion, the third radiation portion has a connecting portion, a first branch and a second branch, the grounding portion, the feed-in portion, the first upright portion, the first longitudinal portion, the second upright portion, the second longitudinal portion, the third upright portion, the third longitudinal portion, the fourth upright portion, the first extending portion, the second extending portion, the connecting portion, the first branch, the second branch, the protruding portion, the fourth radiation portion, the third extending portion and the fourth extending portion are rectangular plate shapes.

18. The multi-band antenna as claimed in claim 1, wherein extending directions of the feed-in portion and the grounding portion are perpendicular to each other, the second radiation portion is perpendicular to the feed-in portion, the second radiation portion and the grounding portion are parallel to each other.

19. A multi-band antenna, comprising:

a grounding portion;

a feed-in portion having a first end edge, a second end edge opposite to the first end edge, a first side edge, and a second side edge opposite to the first side edge, the first side edge being connected with a bottom of the second end edge, the first side edge being close to the grounding portion, and the first side edge keeping a distance from the grounding portion;

a feeding point disposed at the feed-in portion, the feeding point being close to the first side edge and the second end edge;

a first radiation portion, a top edge of the grounding portion extending upward, then meandering rearward, and further extending upward and frontward to form the first radiation portion;

a second radiation portion, an upper portion of the second end edge of the feed-in portion extending rearward to form the second radiation portion, a front of the second radiation portion being connected with the upper portion of the second end edge of the feed-in portion, the first radiation portion and the second radiation portion being located to the same end of the feed-in portion;

a third radiation portion, a lower portion of the first end edge of the feed-in portion extending frontward and then extending upward to form the third radiation portion, a junction between the third radiation portion and the feed-in portion being connected to the first side edge; and a fourth radiation portion, an upper portion of the first end edge of the feed-in portion extending frontward and opposite to the second radiation portion to form the fourth radiation portion, a junction between the fourth radiation portion and the feed-in portion being connected to the second side edge of the feed-in portion, the fourth radiation portion being located among the third radiation portion, the feed-in portion and the first radiation portion;

wherein an extending length of the first radiation portion is longer than an extending length of the second radiation portion, the extending length of the second radiation portion is longer than an extending length of the third radiation portion, an overall extending length of the third radiation portion is longer than an overall extending length of the fourth radiation portion.

20. A multi-band antenna, comprising:

a grounding portion;

a feed-in portion having a first end edge, a second end edge opposite to the first end edge, a first side edge, and a second side edge opposite to the first side edge, the first side edge being connected with a bottom of the second end edge, the first side edge being close to the grounding portion, and the first side edge keeping a distance from the grounding portion;

a feeding point formed at a corner of the feed-in portion between the first side edge and the second end edge;

a first radiation portion, a top edge of the grounding portion extending upward, then meandering rearward, and further extending upward and frontward to form the first radiation portion;

a second radiation portion, an upper portion of the second end edge of the feed-in portion extending rearward to form the second radiation portion, a front of the second radiation portion being connected with the upper portion of the second end edge of the feed-in portion, the first radiation portion and the second radiation portion being located to the same end of the feed-in portion;

a third radiation portion, a lower portion of the first end edge of the feed-in portion extending frontward and then extending upward to form the third radiation portion, a junction between the third radiation portion and the feed-in portion being connected to the first side edge; and a fourth radiation portion, an upper portion of the first end edge of the feed-in portion extending frontward and opposite to the second radiation portion to form the fourth radiation portion, a junction between the fourth radiation portion and the feed-in portion being connected to the second side edge of the feed-in portion, the fourth radiation portion being located among the third radiation portion, the feed-in portion and the first radiation portion, the first radiation portion surrounding the second radiation portion, the fourth radiation portion and the feed-in portion;

wherein an extending length of the first radiation portion is longer than an extending length of the second radiation portion, the extending length of the second radiation portion is longer than an extending length of the third radiation portion, an overall extending length of the third radiation portion is longer than an overall extending length of the fourth radiation portion.

* * * * *